US008284144B2

(12) United States Patent
Misonou et al.

(10) Patent No.: US 8,284,144 B2
(45) Date of Patent: Oct. 9, 2012

(54) METHOD FOR DRIVING A LIQUID CRYSTAL DISPLAY DEVICE

(75) Inventors: Toshiki Misonou, Ichihara (JP); Toshio Maeda, Chiba (JP); Katsumi Matsumoto, Mobara (JP); Hideki Nakagawa, Chiba (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 734 days.

(21) Appl. No.: 10/991,435

(22) Filed: Nov. 19, 2004

(65) Prior Publication Data

US 2005/0104835 A1 May 19, 2005

(30) Foreign Application Priority Data

Nov. 19, 2003 (JP) ..... 2003-389146

(51) Int. Cl.
*G09G 3/36* (2006.01)

(52) U.S. Cl. ..... 345/96; 345/208; 345/209; 345/94

(58) Field of Classification Search ..... 345/204, 345/207, 690, 697, 214, 87–102, 208–210
See application file for complete search history.

(56) References Cited

U.S. PATENT DOCUMENTS

| | | | | |
|---|---|---|---|---|
| 6,914,589 | B2 * | 7/2005 | Choi | 345/96 |
| 7,106,350 | B2 * | 9/2006 | Baba et al. | 345/691 |
| 7,133,035 | B2 * | 11/2006 | Kim et al. | 345/204 |
| 2003/0080932 | A1 * | 5/2003 | Konno et al. | 345/96 |
| 2004/0095304 | A1 * | 5/2004 | Hiroki | 345/87 |

FOREIGN PATENT DOCUMENTS

| | | | |
|---|---|---|---|
| JP | 01261694 | A * | 10/1989 |
| JP | 06089080 | A * | 3/1994 |
| JP | 10-246879 | | 9/1998 |
| JP | 2001-174786 | | 6/2001 |
| JP | 2001174786 | A * | 6/2001 |
| JP | 2002-108288 | | 4/2002 |
| JP | 2003-228046 | | 8/2003 |
| WO | WO 01-57836 | A1 | 2/2000 |

* cited by examiner

*Primary Examiner* — Seokyun Moon
(74) *Attorney, Agent, or Firm* — Antonelli, Terry, Stout & Kraus, LLP.

(57) ABSTRACT

A method for driving a liquid crystal display device that decreases a sticking of the display image. The liquid crystal display device includes a pixel electrode and a counter electrode. A polarity of the signal supplied to the pixel electrode is periodically inverted at the first period and the second period. The length of the first period is different from that of the second period.

17 Claims, 7 Drawing Sheets

METHOD FOR DRIVING A LIQUID CRYSTAL DISPLAY DEVICE

BACKGROUND OF THE INVENTION

The present invention relates to a method for use in driving a liquid crystal display device.

A liquid crystal display device includes a liquid crystal display panel (also called a liquid crystal display element or a liquid crystal cell). The liquid crystal display panel includes a pair of substrates which face each other in an opposed manner, and liquid crystal composition is sandwiched between the two substrates. Pixels are formed on the substrate in a matrix array. These pixels constitute a display part of the liquid crystal display device.

Each pixel includes a pair of electrodes constituted of a pixel electrode and a counter electrode. By use of an electric field which is generated in response to a voltage applied between these electrodes, the optical transmissivity of the liquid crystal is controlled.

As examples of a liquid crystal display device, a vertical electric field type and an in-plane switching type are known. In the vertical electric field type, pixel electrodes are formed on one substrate and counter electrodes are formed on another substrate. In the in-plane switching type, the pixel electrodes and the counter electrodes are formed on the same substrate.

In these liquid crystal display devices, an AC driving method which periodically inverts the polarities of a voltage applied to the liquid crystal layer is performed. This AC driving method is adopted to prevent a deterioration of the liquid crystal which tends to occur when a DC voltage is applied to the liquid crystal. As one AC driving method, there is a known method in which a DC voltage is applied to the counter electrodes, and signal voltages of positive polarity and negative polarity, using a counter electrode voltage as a reference voltage, are alternately applied to the pixel electrodes.

Assuming a period in which all pixels of a liquid crystal display part are driven as one frame, there is a known driving method which changes over the polarities of voltages applied to pixel electrodes for every frame (hereinafter called a frame-inversion driving method). An example of the frame-inversion driving method is disclosed in Pub. No.: US 2002/0008800.

SUMMARY OF THE INVENTION

However, it has been found that, even when a liquid crystal display device is driven using the frame-inversion driving method, there arises a drawback, such as sticking (after image) or the like.

As a cause of these drawbacks, it is estimated that ionic impurities (hereinafter called ions) are present in a trace amount in the inside of the liquid crystal in a state in which the ions are unevenly distributed. This sticking is a phenomenon in which, for example, a fixed image is displayed for a fixed period, and, thereafter, even when the whole surface is changed over to another image, the previous fixed image remains. It has been known that such sticking is relevant to a phenomenon in which the light modulation quantity of the liquid crystal becomes different between the positive-polarity signal frame and the negative-polarity signal frame. That is, this phenomenon is a phenomenon in which unevenly distributed ions remain on a sticking image region, so that, even when the signals are eliminated, the remaining undistributed ions induce a light modulation of the liquid crystal.

Accordingly, it is an object of the present invention to provide a method which can be used for driving a liquid crystal display device to reduce the uneven distribution of ions in a liquid crystal layer.

A summary of representative aspects of the invention disclosed in the present application is as follows.

The present invention is directed to a method of driving a liquid crystal display device including pixel electrodes and counter electrodes, the method comprising the steps of:

applying a common voltage to the counter electrodes;

applying a first image signal to the pixel electrodes during a first period; and applying a second image signal to the pixel electrodes during a second period, wherein the first image signal has a positive polarity with reference to the common voltage, the second image signal has a negative polarity with reference to the common voltage, and the second period is longer than the first period.

The present invention is also directed to a method of driving a liquid crystal display device having a display region on which a plurality of pixels are formed, pixel electrodes which are provided to the pixels, counter electrodes which face the pixel electrodes in an opposed manner, and an image memory which stores display data, the method comprising the steps of:

applying a common voltage to the counter electrodes;

storing display data for one display region in the image memory;

starting a first polarity period in response to outputting of the first polarity changeover signal;

starting a second polarity period in response to outputting of the second polarity changeover signal;

applying video signals of a first polarity to the pixel electrodes during the first polarity period; and applying video signals of a second polarity to the pixel electrodes during the second polarity period, wherein the second polarity and the first polarity constitute reverse polarities relative to each other with reference to a common voltage, a first video signal and a second video signal are voltages in conformity with display data stored in the image memory, and the first polarity period and the second polarity period differ in length.

The present invention is also directed to a method of driving a liquid crystal display device having a display region on which a plurality of pixels are formed, pixel electrodes which are provided to the pixels, counter electrodes which face the pixel electrodes in an opposed manner, and an image memory which stores display data, the method comprising the steps of:

applying a common voltage to the counter electrodes;

storing display data for one display region in the image memory; outputting a first polarity changeover signal in an interval between a first display start signal and a second display start signal and, thereafter, outputting a second polarity changeover signal;

starting a first polarity period in response to outputting of the first polarity changeover signal;

starting a second polarity period in response to outputting of the second polarity changeover signal;

applying video signals of first polarity to the pixel electrodes during the first polarity period; and applying video signals of second polarity to the pixel electrodes during the second polarity period, wherein the second polarity and the first polarity have reverse polarities relative to each other with reference to a common voltage, a first video signal and a second video signal are voltages in conformity with display data stored in the image memory, and the first polarity period and the second polarity period differ in length.

Here, the present invention is not limited to the above-mentioned constitution, and various modifications can be made without departing from the technical concept of the present invention.

DETAILED DESCRIPTION OF THE PREFERRED EMBODIMENTS

Embodiments of a liquid crystal display device according to the present invention will be explained hereinafter in conjunction with the drawings.

Although a liquid crystal display device which is used in a projector is mainly considered by way of example in the explanation presented hereinafter, the present invention is applicable to other liquid crystal display devices.

This is because other liquid crystal display devices are the same as the liquid crystal display device used in a projector with respect to the fact that each pixel of the liquid crystal display device includes a pair of electrodes, light modulation is performed in response to an electric field applied between the electrodes, and AC driving is used for obviating deterioration of the liquid crystal; and, at the same time, other liquid crystal display devices also have the same task to be solved as the liquid crystal display device that is considered in conjunction with the embodiments of the present invention to be described herein.

<<Equivalent Circuit>>

Figure 2:
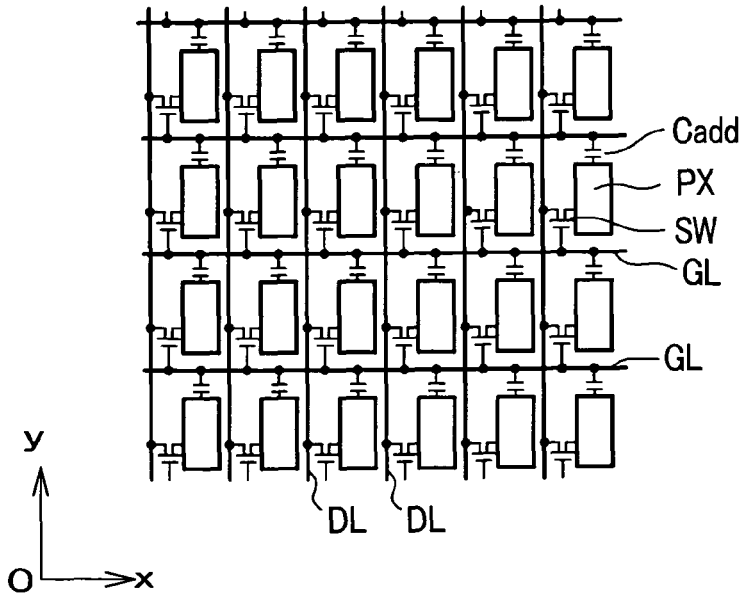
FIG. 2 is an equivalent circuit diagram showing one embodiment of the liquid crystal display device according to the present invention.

FIG. 2 is an equivalent circuit diagram showing one embodiment of the liquid crystal display device according to the present invention. FIG. 2 shows an equivalent circuit of a circuit which is formed on one substrate of the two substrates which constitute a liquid crystal panel. FIG. 2 is drawn corresponding to an actual geometric arrangement of the respective elements which constitute the liquid crystal panel.

On the substrate, there are gate signal lines GL, which extend in the direction x and are arranged in parallel in the direction y, and drain signal lines DL, which extend in the direction y and are arranged in parallel in the direction x. Regions which are surrounded by these respective signal lines constitute pixel regions. Here, a liquid crystal display part of the liquid crystal display device is constituted of an array of these respective pixel regions.

Each pixel region is provided with a switching element SW, which is driven in response to a scanning signal received from the gate signal line GL, and a pixel electrode PX to which a video signal from the drain signal line DL on one side of the pixel region is supplied by way of the switching element SW.

An electric field is generated between the pixel electrode PX and a counter electrode (not shown in the drawing), and, hence, the orientation direction of the liquid crystal composition of the pixel region is changed, thus generating a light modulation. The counter electrodes can be formed on either one of the two substrates which form the liquid crystal display panel.

Further, on the pixel region, a capacitive element Cadd which stores charges during an OFF period of the switching element SW, is formed. In FIG. 2, the capacitive element Cadd is formed between the gate signal line GL and the pixel electrode PX. Here, with respect to the capacitive element, a signal line (a capacitive signal line) which is stable in terms of potential is separately formed in parallel to the gate signal line GL, and the capacitive element is formed of a capacitance which is formed between the capacitive signal line and the pixel electrode.

<<Constitution of a Pixel>>

Figure 3:
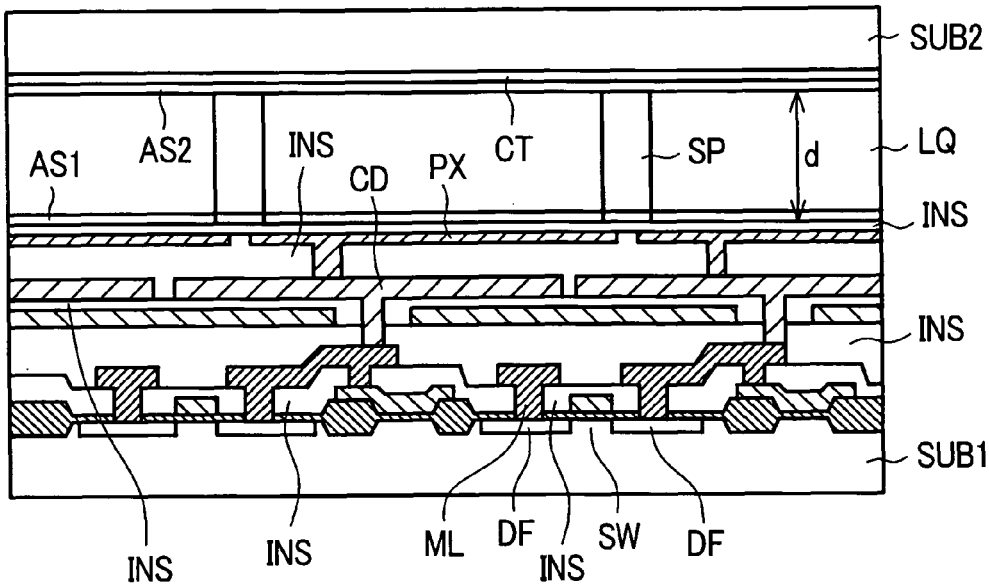
FIG. 3 is a cross-sectional view showing one embodiment of a pixel of the liquid crystal display device according to the present invention.

FIG. 3 is a cross-sectional view of the pixel region of a reflective-type liquid crystal display device.

The reflective-type liquid crystal display device is used in a projector or the like. In the projector, light from a light source is radiated to the reflective-type liquid crystal display device, and reflection light is radiated from the reflective-type liquid crystal display device. The reflection light is enlarged by way of an optical system and is projected on a screen.

In the reflective-type liquid crystal display device, of the respective substrates SUB1, SUB2 which are arranged to face each other with liquid crystal LQ therebetween, one substrate SUB2 is formed as a transparent substrate and the other substrate SUB1 is constituted of a semiconductor substrate. On a liquid-crystal-LQ-side surface of the semiconductor substrate SUB1, switching elements SW are formed. The switching elements SW are formed of a diffusion layer DF, an insulation layer INS, lines ML and the like which are formed on a surface of the semiconductor substrate SUB1. Further, above the lines ML or the like, capacitive elements are formed of conductive layers and the like which are overlapped relative to each other by way of insulation films, wherein one electrode is indicated by symbol CD in the drawing.

On the surface of the semiconductor substrate SUB1, pixel electrodes PX, which are formed of metal or the like (for example, aluminum) and have a favorable reflectance efficiency, are formed. Further, an orientation film AS1, which is directly brought into contact with the liquid crystal, is formed such that the orientation film AS1 also covers the pixel electrodes PX, wherein the initial orientation direction of molecules of the liquid crystal is determined by the orientation film AS1.

On the other hand, on a liquid-crystal-LQ-side surface of the transparent substrate SUB2, which is arranged to face the semiconductor substrate SUB1 by way of the liquid crystal LQ, the counter electrodes CT, which are formed of a light transmitting material (for example, ITO: Indium Tin Oxide), are formed. An orientation film AS2, which is brought into contact with the liquid crystal LQ, is formed such that the orientation film AS2 also covers the counter electrodes CT. The initial orientation direction of the molecules of the liquid crystal LQ also can be determined by the orientation film AS2.

Spacers SP are arranged between the semiconductor substrate SUB1 and the transparent substrate SUB2 in a scattered manner, for example, thus making the layer thickness "d" of the liquid crystal LQ uniform using the spacers SP.

Also, in the liquid crystal display device having such pixels, light from a light source which is radiated from the outside of the transparent substrate SUB2 reaches the pixel electrode PX through the transparent substrate SUB2 and the liquid crystal LQ. As described above, the pixel electrodes PX are formed of a metal having a favorable reflection efficiency or reflectance, and, hence, the light is reflected on the pixel electrodes PX and is radiated to the outside of the transparent substrate SUB2 through the liquid crystal LQ and the transparent substrate SUB2.

Here, the liquid crystal display device which represents the subject of the present invention is not limited to the above-mentioned constitution. That is, the semiconductor substrate may be formed of a transparent substrate and a reflection plate may be formed between the substrates or outside the substrates. Further, the present invention is also applicable to a transmissive-type liquid crystal display device, as opposed to the reflective-type liquid crystal display device.

Here, the transmissive-type liquid crystal display device is a liquid crystal display device which uses a transparent substrate in place of the above-mentioned semiconductor substrate. In such a device, light is incident on one transparent substrate and is irradiated after passing through the liquid crystal and the other transparent substrate. A cold cathode ray tube or a light emitting diode is used as the light source, and the light sources are arranged on a back surface of the liquid crystal display device on a viewer's side. Further, the pixel electrodes are formed on a liquid-crystal-side surface of one transparent substrate, and counter electrodes are formed on a liquid-crystal-side surface of the other transparent substrate. All of the respective electrodes are formed of a light transmitting material over substantially the whole area of both pixel electrodes. Alternatively, the pixel electrodes and the counter electrodes are formed in a strip shape on a liquid-crystal-side surface of one transparent substrate, wherein the pixel electrodes and the counter electrodes are alternately arranged in a state in which they are spaced apart from each other.

<<Driving Method>>

In the liquid crystal display device having such a constitution, a display start signal is inputted to the liquid crystal display device from the outside. Upon receiving the display start signal, the liquid crystal display device sequentially supplies the scanning signal (ON signal) to the respective gate signal lines GL shown in FIG. 2 from above to below, while the liquid crystal display device sequentially supplies a video signal to the respective drain signal lines DL in conformity the timing of the supplying of respective scanning signals.

With respect to the respective pixels for one line, which is constituted of a group of pixels arranged in parallel in the direction x, video signals are supplied to the respective pixel electrodes PX through the switching elements SW, which are simultaneously turned on with the pixels, and this operation is transferred to each respective pixel of the next lines.

Such operations are repeated until the scanning signal reaches the last gate signal line GL. When the scanning signal is supplied to the last gate signal line GL, the writing of the video signals for one screen is completed. The period from a point of time at which the display start signal is inputted from the outside to a point of time at which another display start signal is inputted again will be referred to hereinafter as one frame period (hereinafter also called as "frame") of the liquid crystal display device. Here, in general, the vertical synchronizing signal is used as the display start signal.

On the other hand, the signal which becomes the reference with respect to the video signal (counter voltage Vcom) is supplied to the counter electrodes CT, and an electric field which corresponds to the voltage between the counter electrode CT and the pixel electrode PX is generated with a value which corresponds to the video signal.

Here, as the video signals, positive-side signals and negative-side signals which exhibit a positive-negative symmetry with respect to the signals applied to the counter electrodes are prepared. Then, the liquid crystal display device adopts, in general, a driving method (an AC driving method) in which, for example, the positive-side signals are used at the time of displaying the image of the first frame and the negative-side signals are used at the time of displaying the image of the next frame. When the electric field in one direction is continuously applied to the liquid crystal, the liquid crystal is deteriorated, and, hence, the direction of the electric field applied to the liquid crystal is changed for every frame.

Figure 4:
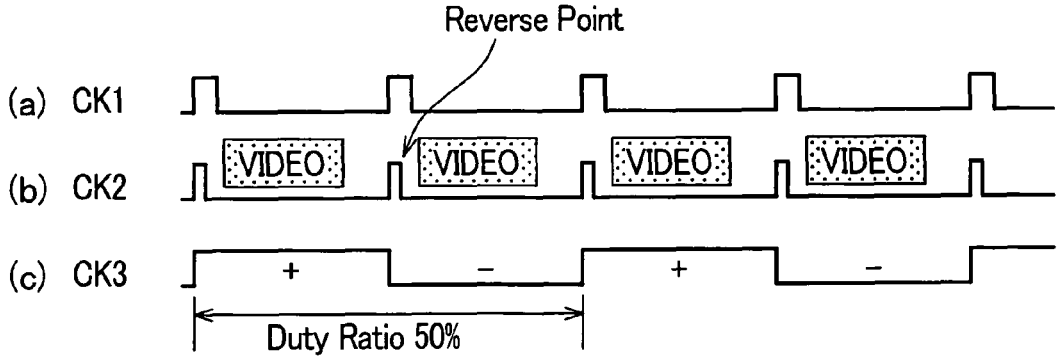
FIG. 4 (Prior Art)
FIG. 4 is a timing chart showing one example of a method for driving the liquid crystal display device when the method for driving according to the present invention is not used.

FIG. 4 is a view showing timings of respective signals in accordance with this driving method. Symbol CK1 indicates a vertical synchronizing signal which is inputted to the liquid crystal display device, and the display of one frame is started along with the inputting of the vertical synchronizing signal CK1. Symbol CK2 indicates a polarity changeover signal which performs the changeover of the polarity of the video signal (VIDEO). In FIG. 4, the polarity changeover signal CK2 is synchronous with the vertical synchronizing signal CK1. FIG. 4 shows that, with respect to the video signal VIDEO, in response to the polarity changeover signal CK2, a signal of positive polarity is supplied to the first frame, a signal of negative polarity is supplied to the next frame, and this signal supplying operation is alternately repeated. In this case, for example, the changeover of signals between the odd-numbered frame and the even-numbered frame is set to a duty ratio of 50%. (Here, the positive polarity means that the voltage exhibits a positive polarity with respect to the voltage applied to the counter electrodes, while the negative polarity means that the voltage exhibits a negative polarity with respect to the voltage applied to the counter electrodes.)

The duty ratio is the time ratio of the positive polarity and the negative polarity when a repeating cycle of writing the positive polarity and the negative polarity of the voltage signal applied to the liquid crystal is set as one cycle.

However, even in such a case, it has been found that a sticking phenomenon arises with respect to the liquid crystal.

The inventors of the present invention have investigated a cause of the phenomenon and have estimated the following as the cause of the phenomenon. That is, for example, the pixel electrodes PX and the counter electrodes CT differ in shape, material and the like, and, hence, the flow of a substance which is charged with ions or the like (hereafter called ions) from the pixel electrode PX, to the counter electrode CT differs from the flow of ions from the counter electrode CT to the pixel electrode PX whereby the ion concentration in the inside of the liquid crystal differs in a direction perpendicular to the electrode substrate.

To explain one example of sticking, it is a phenomenon in which, even when a fixed image in which white, black and other gray scales are present in a mixed form is displayed for a fixed period and, thereafter, the fixed image is changed over to an intermediate gray scale over the whole screen, the previous fixed image remains. This phenomenon is relevant to a phenomenon in which the light modulation quantity of the liquid crystal differs between the positive signal frame and the negative signal frame. That is, the ions which are unevenly distributed at the time of displaying the fixed image remain on the sticking display region, and, hence, even in a state in which the signal is not applied, the remaining unevenly distributed ions induce a light modulation of the liquid crystal.

As shown in FIG. 3, in a reflective-type liquid crystal display device, the substrate on which the pixel electrodes PX are formed is a semiconductor substrate SUB1, while the substrate on which the counter electrodes CT are formed is a transparent substrate SUB2, which is provided as a glass substrate or a plastic substrate. The glass substrate or plastic substrate is an insulating body. Further, while the structural body of the semiconductor substrate SUB1 has a complicated shape, the counter electrodes CT and the like formed on the transparent substrate SUB2 have simple shapes. Further, a fixed voltage is applied to the semiconductor substrate SUB1 as a substrate voltage.

When a steady-state fixed potential difference arises between the semiconductor substrate SUB1 and the transparent substrate SUB2 due to a certain cause at the time of driving the liquid crystal display device, the ions are unevenly distributed in the vicinity of the substrates. During the period in which the liquid crystal display device is driven, being induced by the stationary potential difference, the quantity of unevenly distributed ions is increased. Since the ions are charged, due to the fact that they are unevenly distributed, a potential difference is generated between the pixel electrode PX and the counter electrode CT.

The counter voltage (common voltage) Vcom is arranged at approximately the intermediate level between the signals of positive and negative polarities, such that a difference is not generated on the displayed gray scale between the video signals of positive polarity and those of negative polarity, that is, the light modulation quantity of the liquid crystal becomes equal between the time of applying the voltage of positive polarity and the time of applying the voltage of negative polarity (hereinafter called the accommodated counter voltage Vcom).

Figure 7:
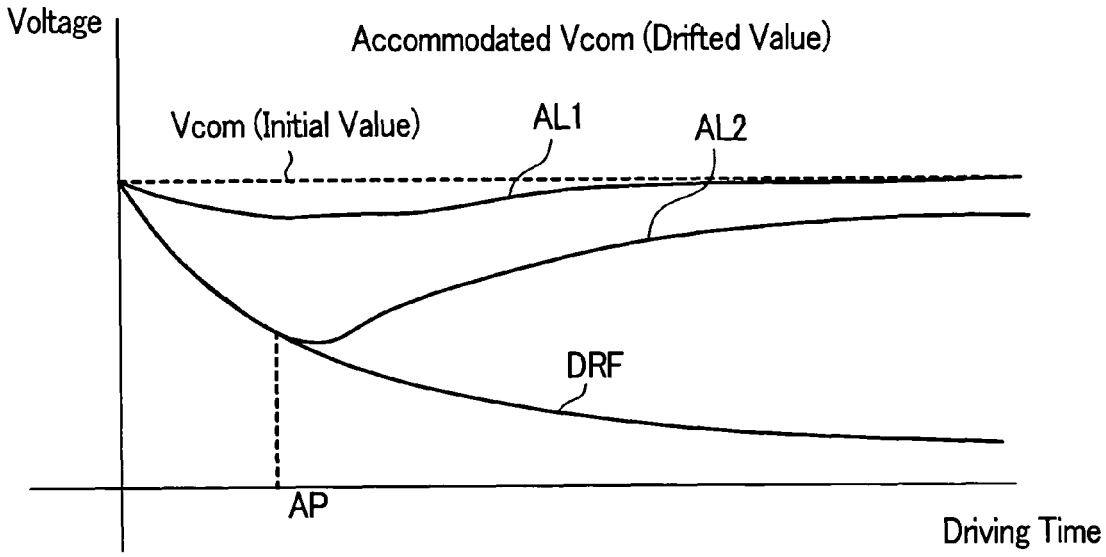
FIG. 7 is a graph showing the change of an optimum counter voltage is of the liquid crystal display device.

When a potential difference is generated between the pixel electrode PX and the counter electrode CT due to the unevenly distributed ions and this potential difference is increased, as indicated by a line DRF in FIG. 7, the value of the proper counter voltage Vcom drifts along with the lapse of driving time. Due to this drifting of the proper counter voltage Vcom, the liquid crystal display device suffers from a lowering of the display quality, such as sticking. Provided that the unevenly distributed ions are not changed and are stably distributed, it may be possible to perform an adjustment by imparting a difference between the positive polarity signal quantity and the negative polarity signal quantity, which are inputted from the outside, so as to offset the electric field to the liquid crystal generated by the unevenly distributed ions. However, when the distribution of the unevenly distributed ions is changed due to such an adjustment of the signal voltage, the drifting of the counter voltage Vcom is generated again due to the change in the distribution of the unevenly distributed ions. That is, this implies that the condition for stabilizing the uneven distribution of ions and the condition for making the light modulation quantity of the liquid crystal equal between the positive polarity signal and the negative polarity signal do not always coincide with each other.

Figure 8:
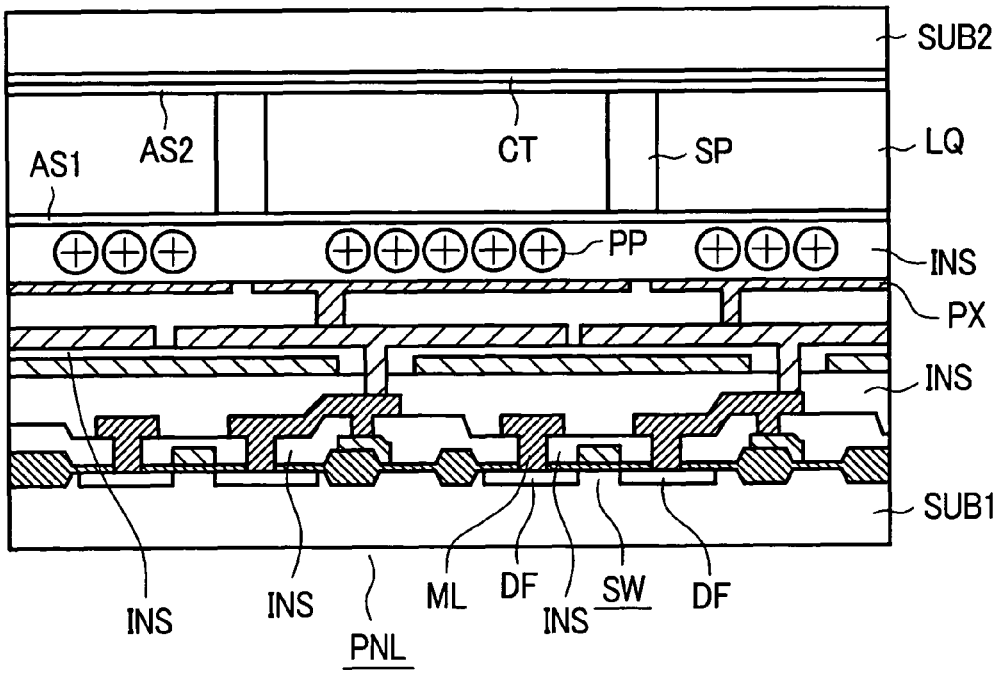
FIG. 8 is a diagrammatic sectional view showing a manner in which charges are unevenly distributed in the liquid crystal display device.

FIG. 8 is a diagram showing the manner in which the ions are unevenly distributed in the liquid crystal display panel PNL. In FIG. 8, to facilitate an understanding of the invention, an insulation film INS between the pixel electrodes PX and an orientation film AS1 is drawn with a large thickness. The insulation film INS is formed of $SiO_2$, SiN or the like. Metal lines and the like are formed on the semiconductor substrate SUB1 in a complicated manner. Accordingly, there exists a sufficient possibility that undesired charges are stored in various portions. FIG. 8 shows a state in which positive charges PP are stored in the insulation film INS between the pixel electrodes PX and the orientation film AS1. The insulation film INS is formed of a multi-layered film, and there exists a sufficient possibility that the charges are trapped between respective layers. These trapped charges constitute an offset between the positive polarity and the negative polarity of the input signal to the liquid crystal. As a method which cancels this offset, a method which preliminarily imparts the difference between the signal voltages of positive polarity and negative polarity or a method which shifts the Vcom voltage in the direction to cancel the Voom voltage is considered.

Figure 9A:
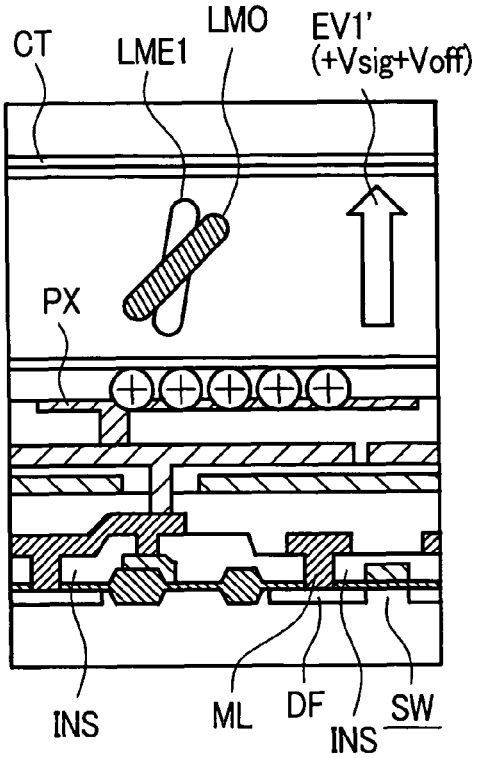
FIGS. 9A and 9B are diagrammatic sectional views showing a manner in which charges are unevenly distributed in the liquid crystal display device.
Figure 9B:
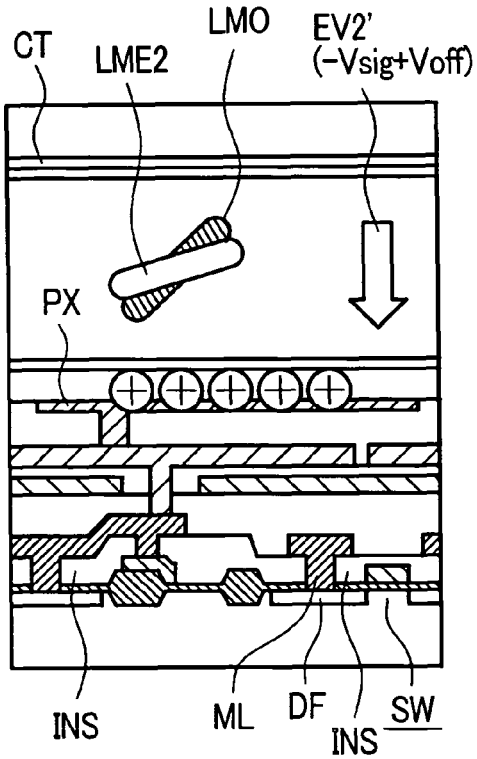

Next, in conjunction with FIGS. 9A and 9B, a phenomenon in which the counter voltage Vcom drifts will be explained with respect to a case in which the positive-type liquid crystal is used and the trapped charge has the positive polarity. FIG. 9A shows a case in which a video signal +Vsig of positive polarity is applied to the pixel electrode PX, and FIG. 9B shows a case in which a video signal (−)Vsig of negative polarity is applied to the pixel electrode PX. Here, there be a case in which the trapped charges may have the negative polarity in the same manner as the positive polarity.

In the case shown in FIG. 9A, a video signal +Vsig of positive polarity is applied to the pixel electrodes PX with reference to the voltage Vcom of the counter electrode. Although the voltage EV1, which is applied between the pixel electrode PX and the counter electrode CT from the outside, is +Vsig, since the positive charge (trapped charge) PP is present in the vicinity of the pixel electrode PX, assuming a voltage generated by the positive charge PP is Voff, the voltage EV1' which is actually applied to the liquid crystal becomes +Vsig+Voff. Accordingly, compared to the state of the liquid crystal molecules LMO which occurs when the trapped charge PP is not present, when the trapped charge PP is present in the vicinity of the pixel electrode PX, the tilting of the liquid crystal molecule LME1 is increased. When the liquid crystal display device is driven in a normally black mode, the liquid crystal display device produces a brighter display compared to the normal display.

In the case shown in FIG. 9B, a video signal (−)Vsig of negative polarity is applied to the pixel electrodes PX with reference to the voltage Vcom of the counter electrode. Although the voltage EV2, which is applied between the pixel electrode PX and the counter electrode CT from the outside, is −Vsig, since the positive charge (trapped charge) PP is present in the vicinity of the pixel electrode PX, assuming a voltage generated by the positive charge PP is Voff, the voltage EV2' which is actually applied to the liquid crystal becomes −Vsig+Voff. Accordingly, compared to the state of the liquid crystal molecules LMO which occurs when the trapped charge PP is not present, when the trapped charge PP is present in the vicinity of the pixel electrode PX, the tilting of the liquid crystal molecule LME1 is increased. When the liquid crystal display device is driven in a normally black mode, the liquid crystal display device produces a darker display compared to the normal display.

In the normally black mode, when the video signal +Vsig of positive polarity is applied to the pixel electrodes PX, the images are displayed more brightly than the normal display, and when the video signal (−)Vsig of negative polarity is applied to the pixel electrodes PX, the images are displayed so as to be darker than the normal display, and, hence, the counter voltage Vcom is adjusted to the positive side relative to the center voltage of the positive polarity signal voltage and the negative polarity signal voltage.

Figure 10A:
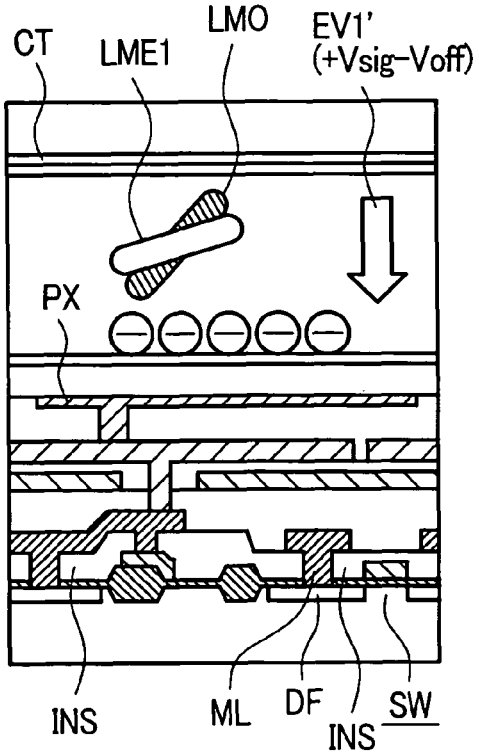
FIGS. 10A and 10B are diagrammatic sectional views showing a manner in which charges are unevenly distributed in the liquid crystal display device.
Figure 10B:
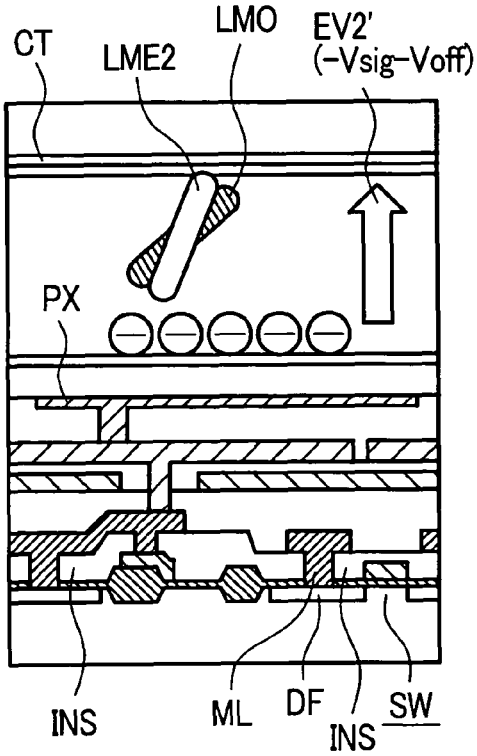

FIGS. 10A and 10B show a case in which the ionic impurities (also called ions) NP are not uniformly distributed (unevenly distributed) in the inside of a liquid crystal layer. In conjunction with FIGS. 10A and 10B, a phenomenon in which the counter voltage Vcom drifts due to unevenly distributed ions will be explained with respect to a case in which positive-type liquid crystal is used, for example. FIG. 10A shows a case in which the video signal +Vsig of positive polarity is applied to the pixel electrodes PX, and FIG. 10B shows a case in which the video signal (−)Vsig of negative polarity is applied to the pixel electrodes PX. Here, although an explanation is made with respect to a case in which the ionic impurities NP have the negative polarity, when the ionic impurities NP have the positive polarity, it is possible to cope with the case by inverting the polarity of the video signal +Vsig.

In FIG. 10A, although the video signal +Vsig of positive polarity is applied to the pixel electrode PX, since the negative charge (ionic impurities) NP is present in the vicinity of the pixel electrode PX, assuming a voltage generated by the negative charge NP is Voff, the voltage EV1' which is actually applied to the liquid crystal becomes +Vsig−Voff. Accordingly, compared to the state of the liquid crystal molecules LMO which occurs when the negative charge NP is not present, when the negative charge NP is present in the vicinity of the pixel electrode PX, the tilting of the liquid crystal molecule LME1 is decreased. When the liquid crystal display device is driven in a normally black mode, the liquid crystal display device produces a darker display compared to the normal display.

In the case shown in FIG. 10B, the video signal (−)Vsig of negative polarity is applied to the pixel electrodes PX. Although the voltage EV2, which is applied between the pixel electrode PX and the counter electrode CT from the outside, is −Vsig, since the negative charge NP is present in the vicinity of the pixel electrode PX, assuming a voltage generated by the negative charge NP is Voff, the voltage EV2' which is actually applied to the liquid crystal becomes −Vsig−Voff. Accordingly, compared to the state of the liquid crystal molecules LMO which occurs when the negative charge NP is not present, when the negative charge NP is present in the vicinity of the pixel electrode PX, the tilting of the liquid crystal molecule LME1 is increased. When the liquid crystal display device is driven in a normally black mode, the liquid crystal display device produces a brighter display compared to the normal display.

In the normally black mode, when the video signal +Vsig of positive polarity is applied to the pixel electrodes PX, the images are displayed so as to be darker than the normal display, and when the video signal (−)Vsig of negative polarity is applied to the pixel electrodes PX, the images are displayed so as to be brighter than the normal display, and, hence, the counter voltage Vcom is adjusted to the negative side relative to the center voltage of the positive polarity signal voltage and the negative polarity signal voltage.

With respect to FIGS. 9A and 9B, an explanation is made with respect to the case in which the fixed charge (stable and having an unchanged distribution) referred to as trapped charge PP is present in the vicinity of the pixel electrode PX. However, as explained in conjunction with FIG. 10, in the actual state, a trace amount of the ionic impurities NP is present in the inside of the liquid crystal. The ionic impurities NP are uniformly distributed in the liquid crystal, and so there arises no problem when the moving speed is low with respect to the frequency of the signal inputted as an alternating current.

Figure 11A:
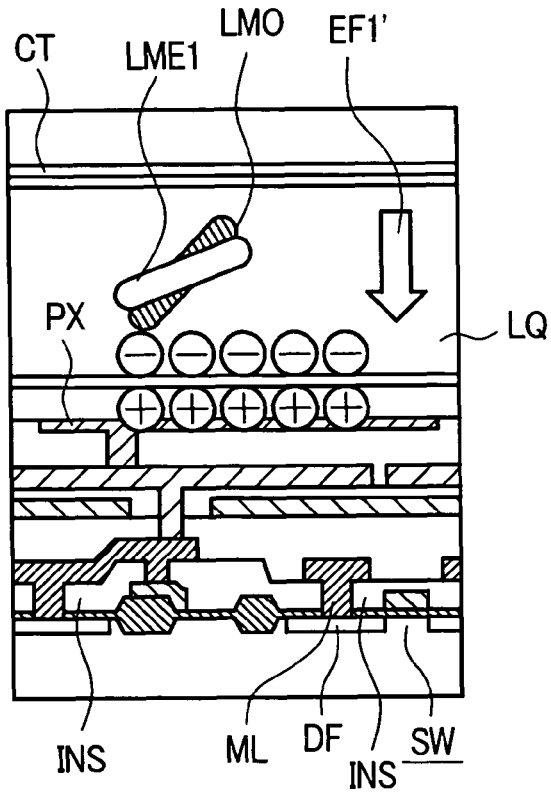
FIGS. 11A and 11B are diagrammatic sectional views showing a manner in which charges are unevenly distributed in the liquid crystal display device.
Figure 11B:
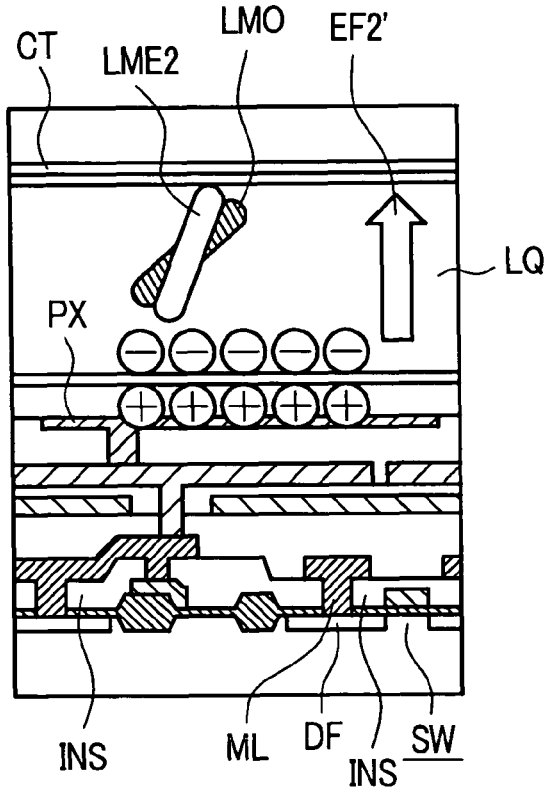

FIGS. 11A and 11B show a case in which the trapped charge PP is present in the vicinity of the pixel electrode PX and the ionic impurities NP are also unevenly present on the pixel electrode side in the liquid crystal layer LQ. In this case, the adjustment of the counter voltage Vcom is performed with a quantity to which an inner electric field attributed to the uneven distribution of the ionic impurities NP in the inside of the liquid crystal is overlapped.

FIG. 11A shows a case in which a video signal +Vsig of positive polarity is applied to the pixel electrodes PX, and FIG. 11B shows a case in which the video signal (−) Vsig of negative polarity is applied to the pixel electrodes PX.

In FIG. 11A, an electric field EFI between the pixel electrode PX and the counter electrode CT usually becomes the difference between the voltage Vcom of the counter electrode CT and the voltage Vsig of the pixel electrode PX. Since the negative charge NP is present in the vicinity of the pixel electrode PX, assuming that the voltage generated by the negative charge NP is Voff, the electric field EF1' applied to the liquid crystal molecules is decreased by the voltage Voff. Accordingly, compared to the usual liquid crystal molecules LMO, when the negative charge NP is present in the vicinity of the pixel electrode PX, the tilting of the liquid crystal molecules LME1 is decreased. When the liquid crystal display device is used in the normally black mode, a display darker than the normal display is generated.

In FIG. 11B, when the video signal (−)Vsig of negative polarity is applied to the pixel electrode PX, the electric field EF2 usually becomes the difference between the voltage Vcom of the counter electrode CT and the voltage −Vsig of the pixel electrode PX. Since the negative charge NP is present in the vicinity of the pixel electrode PX, assuming that the voltage generated by the negative charge NP is Voff, the electric field EF2' applied to the liquid crystal molecules is increased by the voltage Voff. Accordingly, compared to the usual liquid crystal molecules LMO, when the negative charge NP is present in the vicinity of the pixel electrode PX, the tilting of the liquid crystal molecules LME1 is increased. When the liquid crystal display device is used in the normally black mode, display that is brighter than the normal display is generated.

When the video signal +Vsig of positive polarity is applied to the pixel electrode PX, a display that is darker than the normal display is produced, and when the video signal (−)Vsig of negative polarity is applied to the pixel electrode PX, a display that is brighter than the normal display is produced, and, hence, the counter voltage Vcom is adjusted to the proper voltage. In the above-mentioned case, the counter voltage Vcom is adjusted to the negative side relative to the initial voltage.

However, when the counter voltage Vcom is adjusted, the electric field generated in the inside of the liquid crystal is changed, and, hence, an uneven distribution of the ionic impurities takes on a distribution that is different from the distribution before adjustment (the uneven distribution quantity being increased). Accordingly, there arises a difference in the contrast in the display between the time of the positive polarity signal and the time of the negative polarity signal again.

As a cause of the uneven distribution of the ionic impurities, the materials of the upper and lower substrate electrodes, an interface treatment process of the orientation film and the like a factor. For example, the ionic impurities which are induced by signal voltages of positive polarity and negative polarity applied from the outside and which reach the interfaces of the electrodes are attracted to the orientation film or the like or the ionic impurities are easily removed from the orientation film due to the changeover of the polarities of the signal voltage. The uneven distribution of the ionic impurities is caused between the upper and lower substrates due to the easiness of the above-mentioned attraction or removal of the ionic impurities.

When the ionic impurities are unevenly distributed in the inside of the liquid crystal and the uneven distribution is adjusted by adjusting the light modulation quantity of the liquid crystal based on the difference between the signal voltage of positive polarity and the signal voltage of negative polarity or the Vcom voltage, it is preferable that the uneven distribution of the ionic impurities is not generated again. However, the adjustment of electric field on the liquid crystal simultaneously acts on the ionic impurities in the inside of the liquid crystal and increases the quantity of unevenly distributed ionic impurities, and, hence, it is difficult to completely suppress the sticking which is generated due to the uneven distribution of the ionic impurities.

For purposes of suppressing the uneven distribution of ions, the driving method employed by this embodiment changes the ratio between the period in which the video signal of positive polarity is applied to the pixel electrodes PX and the period in which the video signal of negative polarity is applied to the pixel electrodes PX.

Figure 1:
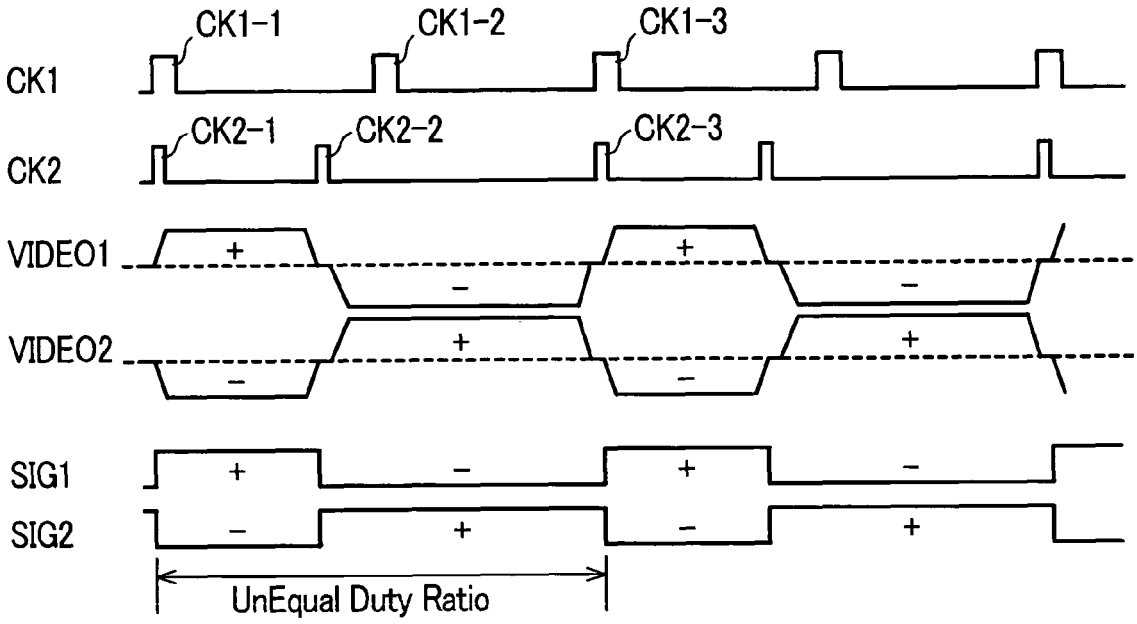
FIG. 1 is a timing chart showing one embodiment of a method for driving a liquid crystal display device according to the present invention.

The driving method will be explained in conjunction with FIG. 1. FIG. 1 corresponds to FIG. 4, wherein symbol CK1 indicates a vertical synchronizing signal which is inputted to the liquid crystal display device and the frames are changed over in response to the inputting of the vertical synchronizing signal CK1. Symbol CK2 indicates a polarity changeover signal which performs the changeover of the polarity of the video signal (VIDEO). In the drawing, the polarity changeover signal CK2-2 which comes next to the first polarity changeover signal CK2-1 in the drawing is set to be slightly faster than the vertical synchronizing signal CK1-2. Further, the polarity changeover signal CK2-3 which comes next is set at a substantially equal timing as the next synchronizing signal CK1-3.

FIG. 4 shows that the above-mentioned changeover operations are repeated thereafter. Symbols SIG1 and SIG2 show the polarities of the video signal which is written in the pixel electrodes PX. The symbol SIG1 shows a case in which the period of negative polarity is to be set longer than the period of positive polarity, while the symbol SIG2 shows a case in which the period of positive polarity is set to be longer than the period of negative polarity.

Due to such setting of the periods of positive polarity and negative polarity, in one certain frame and the frame which follows next, the polarity of the video signal which is supplied to the respective pixels at the same position can be driven such that, as shown in the drawing, when the polarity of ions which are unevenly distributed in the pixel electrode PX is negative, the time that the positive polarity is applied is short and the time that the negative polarity is applied is long, as indicated by the symbol SIG1. On the other hand, when the polarity of ions which are unevenly distributed in the pixel electrode PX is positive, the time that the negative polarity is applied is short and the time that the positive polarity is applied is long, as indicated by the symbol SIG2.

Due to such a driving method, the uneven distribution of the ions in the inside of the liquid crystal layer is prevented by changing each time ratio of the positive polarity of the video signal.

Figure 5:
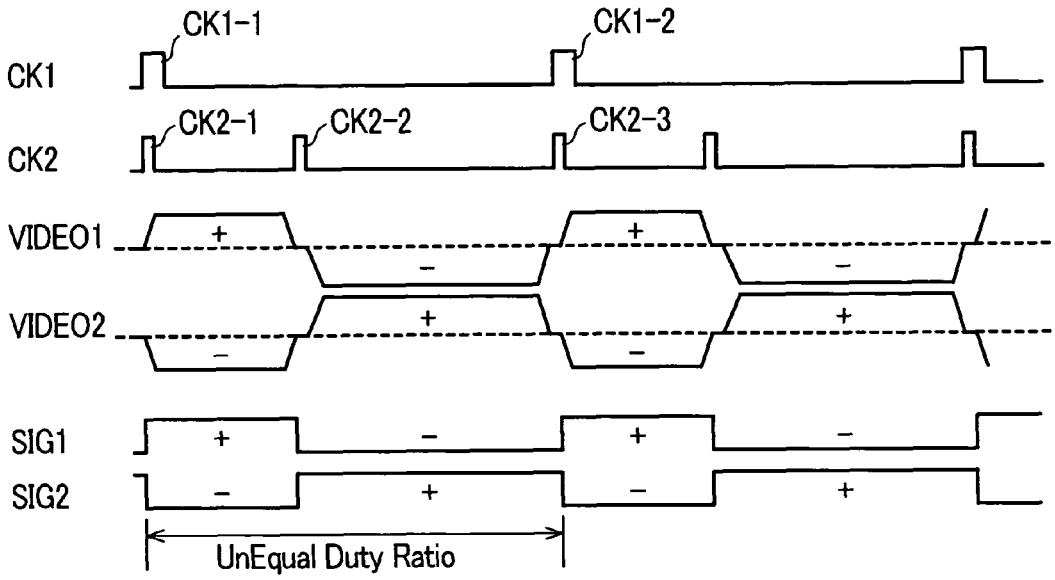
FIG. 5 is a timing chart showing another embodiment of a method for driving a liquid crystal display device according to the present invention.

In FIG. 5, a driving method which writes the video signal twice during one frame period is shown. In FIG. 5, between two vertical synchronizing signals CK1, the video signal is written twice in the pixels of the display region. The image data for one screen of the display region is stored in an image memory (also called a frame memory), wherein video signals having different polarities are written in the pixel electrodes PX one time for each video signal during one frame period using the same image data.

Also in FIG. 5, the ratio of respective times for positive polarity and negative polarity of the applied video signal is changed. During the time from the generation of the polarity changeover signal CK2-1 to the generation of the polarity changeover signal CK2-2, the time in which the video signal is applied is shortened, and, hence, it is possible to prolong the time in which the video signal is applied during the time from the generation of the polarity changeover signal CK2-2 to the generation of the polarity changeover signal CK2-3.

It is needless to say that the flow of the ions from the pixel electrode PX to the counter electrode CT may take the following mode depending on the degree of difference of the flow of ions from the counter electrode CT to the pixel electrode PX. That is, as shown in FIG. 6, the video signal of positive (negative) polarity is given in one frame, the video signal of negative (positive) polarity is given in the next frame, and the video signal of negative (positive) polarity is given in the further next frame, and these operations are repeated.

That is, with respect to the liquid crystal of each pixel, in the respective polarities of the signal (voltage) applied in a sequentially changed-over manner, it is sufficient that the signal application time for one polarity is different from the signal application time for the other polarity. In this case, the polarity of the signal (voltage) which is applied to the liquid crystal is determined based on the value of the voltage applied to the counter electrode CT and the value of the voltage applied to the pixel electrode PX; wherein, when the liquid crystal is driven such that the polarity of the reference voltage signal applied to the counter electrode CT is changed, the liquid crystal display device is driven in a state in which the polarity of the video signal which is applied to the pixel electrode PX is changed to have the above-mentioned relationship.

Figure 6:
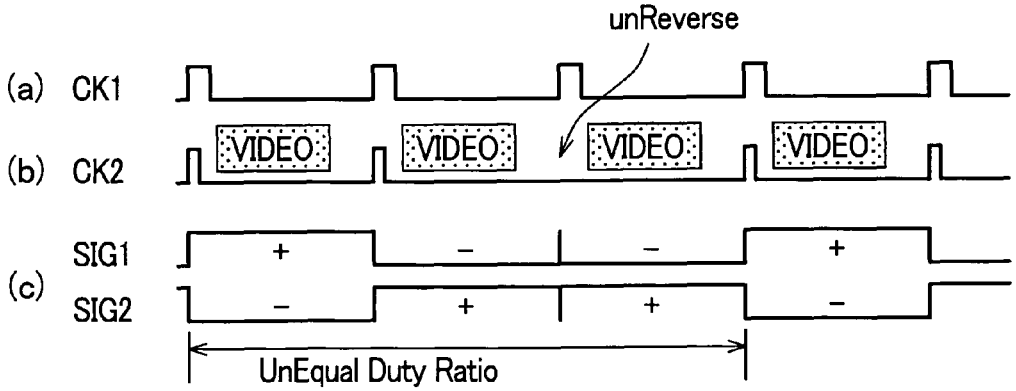
FIG. 6 is a timing chart showing still another embodiment of a method for driving a liquid crystal display device according to the present invention.

In view of the above, it should be apparent that the driving method is not limited to the methods shown in FIG. 1, FIG. 5 and FIG. 6. Rather, the above-mentioned technical concept is applicable to driving methods which are based on line inversion driving, row inversion driving and dot inversion driving as well.

Line inversion driving is a method in which, in sequentially driving groups of pixels (lines), each of which is constituted of respective pixels which are arranged in parallel in the x axial direction from the upper side to the lower side, for example, the respective pixels of one pixel group are driven with the positive polarity (negative polarity), and, thereafter, the respective pixels of the next one pixel group are driven with the negative polarity (positive polarity), and such driving is sequentially repeated such that a reverse polarity relationship is established each time the frame is changed over.

In this case, the driving may be performed such that, for example, first of all, the data is written by selecting only lines of positive polarity, and, thereafter, only the data of negative polarity is written. That is, the operation to select every one other gate signal line GL is performed twice in one frame.

Further, row inversion driving is a method in which, in the same manner as the line inversion driving method, in sequentially driving groups of pixels (lines), each of which is constituted of respective pixels which are arranged in parallel in the x axial direction from the upper side to the lower side, for example, in driving the respective pixels of one pixel group, the respective pixels are driven in the order of positive polarity, negative polarity, positive polarity, negative polarity, . . . from the left side to the right side, for example. Also, in the next pixel group, the respective pixels are driven in order of positive polarity negative polarity, positive polarity, negative polarity, . . . from the left side to the right side, and, thereafter, such driving is repeated to establish a reverse polarity relationship at the time of changing over the frame.

Further, dot inversion driving is a method in which, in the same manner as the line inversion driving method, in sequentially driving groups of pixels (lines), each of which is constituted of respective pixels which are arranged in parallel in the x axial direction from the above-side to the lower side, for example, in driving the respective pixels of one pixel group, the respective pixels are driven in order of positive polarity, negative polarity, positive polarity, negative polarity, . . . from the left side to the right side, for example. Also, in the next pixel group, the respective pixels are driven in the order of negative polarity, positive polarity, negative polarity, positive polarity . . . from the left side to the right side, and, thereafter, such driving is repeated to establish a reverse polarity relationship at the time of changing over the frame.

In the above-mentioned row inversion driving and dot inversion driving, first of all, the data of positive polarity or negative polarity of a certain line is written, and, thereafter, the gate signal lines GL are selected again from the head line and only the data of negative polarity or positive polarity is written. Here, into the pixels in which the data of positive polarity or negative polarity is already written, it is possible to write so-called black data. In this manner, it is possible to realize a black insertion, which is preferable in a moving image display.

Figure 12:
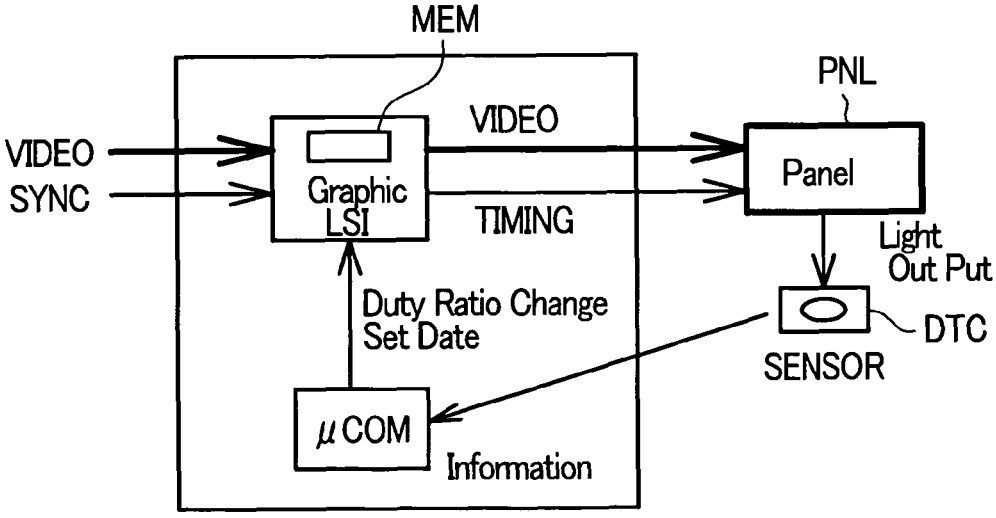
FIG. 12 is a diagram showing one embodiment of a method for detecting a proper duty ratio in a so-called AC driving of the liquid crystal display device according to the present invention.

FIG. 12 is a diagram showing an embodiment of a method for setting a duty ratio to a proper value at the time of applying the voltage to the liquid crystal of each pixel by changing over the positive polarity and the negative polarity. In the drawing, information on the pixel, which is obtained from the liquid crystal display panel PNL, is detected by a sensor (an optical detector) DTC, and an output of the sensor DTC is inputted to a control circuit uCOM.

Then, based on the result of an arithmetic operation performed by the control circuit uCOM, the output timing of a clock signal (for example, corresponding to the polarity changeover signal CK2 in FIG. 1 and FIG. 5) received from an image memory MEM which allows the inputting of the video signal (VIDEO) or the like in the liquid crystal display panel (PNL) is controlled.

By adopting the constitution shown in FIG. 12, as indicated by a line AL1 in FIG. 7, it is possible to suppress the change of the optimum counter voltage Vcom to a small value. On the other hand, a line AL2 is provided for setting a duty ratio to a proper value at a point of time AP. According to the line AL2, along with a lapse of time to the point of time AP, the value of the optimum counter voltage Vcom is changed, and so it is difficult to prevent the lowering of the display quality, such as sticking, flickering and the like, of screen during that period.

Here, with respect to the above-mentioned information obtained from the liquid crystal display panel PNL, it is preferable to obtain the information from the pixel for the inspection which is formed on the region of the liquid crystal display panel PNL, for example, which is formed separately on a position slightly remote from the liquid crystal display part thereof. This is because of the fact that, when the pixel for inspection is provided in the inside of the liquid crystal display part, the pixel for inspection becomes an obstacle when a viewer watches images. Although the number of pixels for inspection may be one pixel, for example, it is preferable that a plurality of pixels are arranged close to each other to have a sufficient light quantity.

The pixel for inspection is driven under conditions that are equal to the conditions for driving respective pixels of the liquid crystal display part. The duty ratio at which the voltage is applied by changing over the positive polarity and the negative polarity, signals applied to the counter electrodes CT and the signals applied to the pixel electrodes PX, are also equal to those used for driving the liquid crystal display part.

Further, the sensor DTC is arranged to face the pixel for inspection in an opposed manner so as to detect the quantity of light emitted from the pixel. An output of the sensor DTC is transmitted to the control circuit uCOM, and the difference between the quantity of light when the signal of positive polarity is applied to the pixel and the quantity of light when the signal of negative polarity is applied to the pixel is calculated by the control circuit uCOM.

When the difference becomes 0, this implies that the quantity of light at the time of applying the signal of positive polarity to the pixel for inspection and the quantity of light at the time of applying the signal of negative polarity to the pixel for inspection is equal. That is, this implies that, under the current situation, in so far as the pixel is concerned, the value of the duty ratio at the time of applying the voltage by changing over the positive polarity and the negative polarity is proper or appropriate. This also implies that the value of the duty ratio is appropriate or proper also with respect to the respective pixels of the liquid crystal display part.

When the difference assumes a value other than 0, this implies that the value of the duty ratio is not proper, and, hence, the correction of the duty ratio becomes necessary. For example, when the quantity of light at the time of applying the signal of positive polarity to the pixel (pixel for detection) is larger than the quantity of light at the time of applying the signal of negative polarity to the pixel (pixel for detection), the value of the duty ratio is made to approximate the proper value by decreasing the time for applying the signal of positive polarity or by increasing the time for applying the signal of negative polarity. In the same manner, when the quantity of light at the time of applying the signal of positive polarity to the pixel (pixel for detection) is smaller than the quantity of light at the time of applying the signal of negative polarity to the pixel (pixel for detection), the value of the duty ratio is made to approximate the proper value by increasing the time for applying the signal of positive polarity or by decreasing the time for applying the signal of negative polarity. Such a control is also performed by the control circuit uCOM based on the above-mentioned arithmetic operation values. Here, the sensor may be constituted of a sensor which detects only blue light which receives the largest influence from the ionic material or a sensor which can detect all of three primary colors in color.

In driving such a liquid crystal display device, the deterioration of the liquid crystal of each pixel can be properly reduced by adding a point of view, that is, the difference in the flow of ions in respective positive-polarity and negative-polarity applied states. Further, it is also possible to obviate a drawback that, due to the generation of the electrical imbalance attributed to the difference in respective times of application of positive and negative polarities, the reference voltage (Vcom) applied to the counter electrode CT drifts, and, hence, the brightness at the time of writing the positive electrode and negative electrode can be changed.

In this change of brightness, when a display of black (0 gray scale) is to be displayed, for example, the positive polarity (0 gray scale) and the negative polarity (10 gray scale) are alternately changed over, and, hence, a display having a gray scale of (0+10)/2=5 becomes a display in a state in which black is shifted to the white-side gray scale (looking whitish) by five gray scales. According to the driving method of this embodiment, the generation of such a phenomenon also can be prevented.

Figure 13:
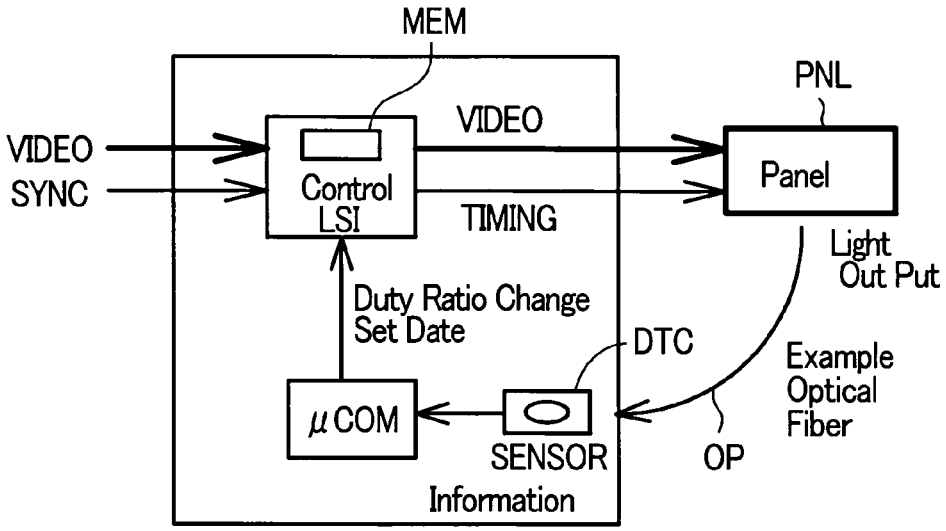
FIG. 13 is a diagram showing another embodiment of a method for detecting a proper duty ratio in a so-called AC driving of the liquid crystal display device according to the present invention.

Here, in the embodiment explained in conjunction with FIG. 12, the duty ratio is set to the proper value based on the information received from the sensor DTC, which is arranged to face the liquid crystal display panel PNL in an opposed manner. However, it is needless to say that, for example, as shown in FIG. 13, light from the pixel of the liquid crystal display panel PNL is introduced to the sensor DTC, which is arranged in a relatively spaced apart manner from the liquid crystal display panel PNL by way of an optical fiber OP, for example, so as to perform an operation that is substantially equal to the above-mentioned operation.

Figure 14A:
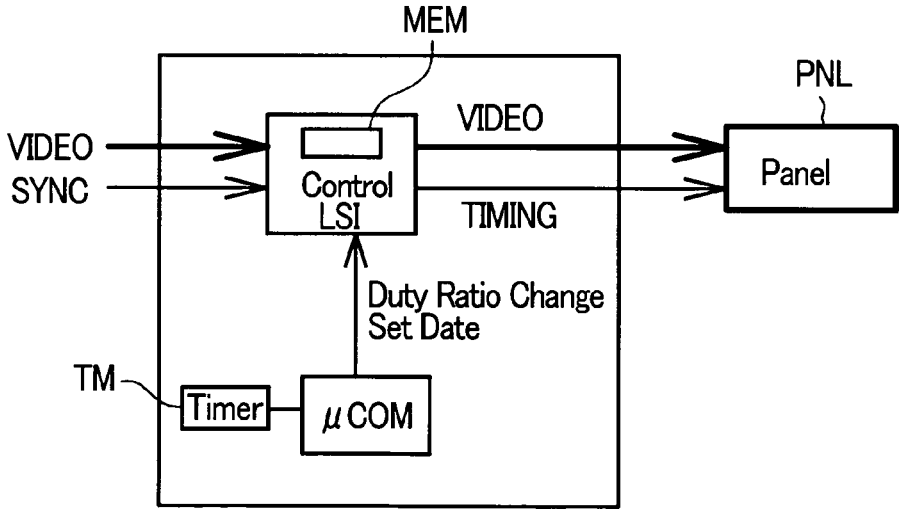
FIG. 14A is a diagram and FIG. 14B is a timing chart showing still another embodiment of a method for detecting a proper duty ratio in a so-called AC driving of the liquid crystal display device according to the present invention.

Further, the duty ratio may be changed along with a lapse of time using a timer TM, as shown in FIG. 14A, without using the above-mentioned sensor DTC. That is, an output of the timer is inputted to the control circuit uCOM and the control circuit uCOM controls the output timing of a clock (corresponding to the polarity changeover signal CK2 in FIG. 1, for example) from the image memory, which allows inputting of the video signal (VIDEO) and the like to the liquid crystal display panel for a lapse of every given time.

Figure 14B:
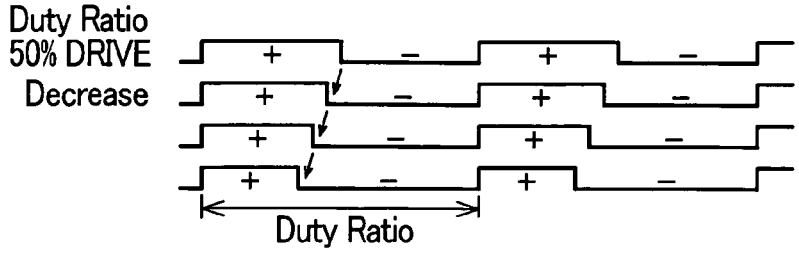

FIG. 14B shows the changeover of the positive polarity and the negative polarity of the video signal along with a lapse of time, which is performed in response to the polarity changeover signal CK2. For example, in a two frame period, first of all, the time of the video signal of positive polarity is gradually shortened, and, correspondingly, the time of the video signal for the next negative polarity is prolonged.

In this case, in the liquid crystal display device in which the above-mentioned control circuit uCOM and the like are incorporated, it is necessary to recognize the change of some elements, which show the degree of the progress of the deterioration of the liquid crystal along with the lapse of time, and, hence, the characteristics are stored in a memory (not shown in the drawing), and the proper duty ratio is set based on the information stored in the memory. Here, as the element which indicates the degree of the deterioration of the liquid crystal or the like, an accumulated light quantity of a light source or the like, which is radiated to the liquid crystal display device, can be given as an example.

Although the present invention has been explained in conjunction with the above-mentioned embodiments, the inventors of the present invention have found that the influence of the ionic impurities can be sufficiently reduced by setting the duty ratio from 55 percent to 70 percent.

The above-mentioned respective embodiments can be respectively used in a single form or in combination. This is because the respective embodiments can produce the respective advantageous effects in a single form or synergistically.

What is claimed is:

1. A method for driving a liquid crystal display device including pixel electrodes, counter electrodes and liquid crystal provided between the pixel electrode and the counter electrodes, to suppress an uneven distribution of ions in the liquid crystal, the method comprising the steps of:

applying a common voltage to the counter electrodes;

applying a first image signal to the pixel electrodes;

applying a second image signal to the pixel electrodes, applying a first clock for starting a frame period;

applying a second clock for changing a polarity of the first and second image signals, applying another second clock for again changing a polarity of the first and second image signals, and applying another first clock after said another second clock has been applied, wherein:

the first image signal has a positive polarity with reference to the common voltage, the second image signal has a negative polarity with reference to the common voltage, the first image signal and the second image signal are applied to respective pixels at the same position, the common voltage drifts from an intermediate value of the first image signal and the second image signal, the first image signal is applied to the liquid crystal during a first applying period started by the second clock, the second image signal is applied to the liquid crystal during a second applying period started by the another second clock, the frame period is repeated periodically, a time spacing between said second clock and said another second clock is shorter than a time spacing between said first clock and said another first clock, the second applying period is longer than the first applying period to thereby suppress the uneven distribution of ions in the liquid crystal, and the another first clock and the another second clock are output asynchronously.

2. A method for driving a liquid crystal display device according to claim 1, wherein the liquid crystal display device is a reflective-type liquid crystal display device for a projector.

3. A method for driving a liquid crystal display device according to claim 1, wherein the method further includes a step of detecting a quantity of light emitted from a pixel of the liquid crystal display device and setting a length of the first period in response to the quantity of light.

4. A method for driving a liquid crystal display device according to claim 1, wherein the method further includes a step of detecting a quantity of light emitted from a pixel for detection and setting a length of the first period in response to the quantity of light.

5. A method for driving a liquid crystal display device according to claim 1, wherein the method further includes a step of setting the first period based on a radiation time accumulated quantity of light radiated to the liquid crystal display device.

6. A method for driving a liquid crystal display device including a display region on which a plurality of pixels are formed, pixel electrodes which are provided to the pixels, counter electrodes which face the pixel electrodes in an opposed manner, a liquid crystal provided between the pixel electrode and the counter electrodes and an image memory which stores display data, to suppress an uneven distribution of ions in the liquid crystal, the method comprising the steps of:

applying a common voltage to the counter electrodes;

storing display data in the image memory;

starting a first polarity period in response to outputting of a first polarity changeover signal;

starting a second polarity period in response to outputting of a second polarity changeover signal;

applying a first clock for starting a frame period, applying another first clock after said second polarity changeover signal has been applied;

applying video signals of first polarity to the liquid crystal during the first polarity applying period started by the first polarity changeover signal; and applying video signals of second polarity to the liquid crystal during the second polarity applying period started by the second polarity changeover signal, wherein:

the video signals of the first polarity and the second polarity are applied to respective pixels at the same position, a second polarity and a first polarity have reverse polarities from each other with reference to a common voltage, the common voltage drifts from an intermediate value of the signal of first polarity and the signal of second polarity, a first video signal and a second video signal are voltages in conformity with display data stored in the image memory, the frame period is repeated periodically, a time spacing between the first polarity changeover signal and the second polarity changeover signal is shorter than a time spacing between the first clock and said another first clock, the first polarity applying period and the second polarity applying period differ in length to thereby suppress the uneven distribution of ions in the liquid crystal, and the another first clock and the second polarity changeover signal are output asynchronously.

7. A method for driving a liquid crystal display device according to claim 6, wherein the liquid crystal display device is a reflective-type liquid crystal display device for a projector.

8. A method for driving a liquid crystal display device according to claim 6, wherein the method further includes a step of detecting a quantity of light emitted from a pixel of the liquid crystal display device and setting a length of the first period in response to the quantity of light.

9. A method for driving a liquid crystal display device according to claim 6, wherein the method further includes a step of detecting a quantity of light emitted from a pixel for detection and setting a length of the first period in response to the quantity of light.

10. A method for driving a liquid crystal display device according to claim 6, wherein the method further includes a step of setting the first period based on a radiation time accumulated quantity of light radiated to the liquid crystal display device.

11. A method for driving a liquid crystal display device, including a display region on which a plurality of pixels are formed, pixel electrodes which are provided to the pixels, counter electrodes which face the pixel electrodes in an opposed manner, a liquid crystal provided between the pixel electrode and the counter electrodes and an image memory which stores display data, to suppress an uneven distribution of ions in the liquid crystal, the method comprising the steps of:

applying a common voltage to the counter electrodes;

storing display data for one display region in the image memory;

outputting a first polarity changeover signal in an interval between a first display start signal and a second display start signal and, thereafter, outputting a second polarity changeover signal;

starting a first polarity period in response to outputting of the first polarity changeover signal;

starting a second polarity period in response to outputting of the second polarity changeover signal;

applying a first clock for starting a frame period, applying another first clock after said second polarity changeover signal has been applied;

applying video signals of first polarity to the liquid crystal during the first polarity applying period started by the first polarity changeover signal; and applying video signals of second polarity to the liquid crystal during the second polarity applying period started by the second polarity changeover signal, wherein:

the video signals of the first polarity and the second polarity are applied to respective pixels at the same position, a second polarity and a first polarity have reverse polarities from each other with reference to a common voltage, the common voltage drifts from an intermediate value of the signal of first polarity and the signal of second polarity, a first video signal and a second video signal are voltages in conformity with display data stored in the image memory, the frame period is repeated periodically, a time spacing between the first polarity changeover signal and the second polarity changeover signal is shorter than a time spacing between the first clock and said another first clock, and the first polarity applying period and the second polarity applying period differ in length to thereby suppress the uneven distribution of ions in the liquid crystal, and the first clock and the second polarity changeover signal are output asynchronously.

12. A method for driving a liquid crystal display device according to claim 11, wherein the liquid crystal display device is a reflective-type liquid crystal display device for a projector.

13. A method for driving a liquid crystal display device according to claim 11, wherein the method further includes a step of detecting a quantity of light emitted from a pixel of the liquid crystal display device and setting a length of the first period in response to the quantity of light.

14. A method for driving a liquid crystal display device according to claim 11, wherein the method further includes a step of detecting a quantity of light emitted from a pixel for detection and setting a length of the first period in response to the quantity of light.

15. A method for driving a liquid crystal display device according to claim 11, wherein the method further includes a step of setting the first period based on a radiation time accumulated quantity of light radiated to the liquid crystal display device.

16. A method for driving a liquid crystal display device according to claim 6, wherein the video signals of the first polarity are applied to the pixel electrodes during the first polarity period and the video signals of the second polarity are applied to the pixel electrodes during the second polarity period.

17. A method for driving a liquid crystal display device according to claim 11, wherein the video signals of the first polarity are applied to the pixel electrodes during the first polarity period and the video signals of the second polarity are applied to the pixel electrodes during the second polarity period.

* * * * *